US010309125B2

(12) United States Patent
Beck

(10) Patent No.: US 10,309,125 B2
(45) Date of Patent: Jun. 4, 2019

(54) ELECTRONIC LOCK WITH DOOR ORIENTATION SENSING

(71) Applicant: SPECTRUM BRANDS, INC., Middleton, WI (US)

(72) Inventor: Chasen Beck, Costa Mesa, CA (US)

(73) Assignee: Spectrum Brands, Inc., Middleton, WI (US)

( * ) Notice: Subject to any disclaimer, the term of this patent is extended or adjusted under 35 U.S.C. 154(b) by 28 days.

(21) Appl. No.: 15/401,359

(22) Filed: Jan. 9, 2017

(65) Prior Publication Data

US 2017/0198496 A1 Jul. 13, 2017

Related U.S. Application Data

(60) Provisional application No. 62/277,171, filed on Jan. 11, 2016.

(51) Int. Cl.
*E05B 17/22* (2006.01)
*E05B 47/00* (2006.01)

(52) U.S. Cl.
CPC ..... *E05B 17/22* (2013.01); *E05B 2047/0068* (2013.01); *E05B 2047/0094* (2013.01)

(58) Field of Classification Search
CPC ..... E05B 2047/0023; E05B 2047/0067; E05B 2047/0094; E05B 2047/0068; E05B 47/0012; E05B 65/1053; E05B 65/1093; E05B 17/22; E05F 15/00; E05F 15/603; E05F 15/40
See application file for complete search history.

(56) References Cited

U.S. PATENT DOCUMENTS 8,495,836 B2 * 7/2013 Lowder ..... E05B 65/1053 292/92
9,224,287 B2 12/2015 Vitkus et al.
9,528,294 B2 * 12/2016 Johnson ..... G07C 9/00174
9,574,372 B2 * 2/2017 Johnson ..... E05B 1/0007
2005/0091928 A1 * 5/2005 Okulov ..... E05F 15/41 49/341
2006/0242908 A1 * 11/2006 McKinney ..... E05F 15/60 49/280
2010/0019902 A1 1/2010 Mullet
(Continued)

FOREIGN PATENT DOCUMENTS

WO 2014154738 A1 10/2014

OTHER PUBLICATIONS

International Search Report and Written Opinion for International Application No. PCT/US2017/012791, dated Mar. 30, 2017.

*Primary Examiner* — Justin B Rephann
(74) *Attorney, Agent, or Firm* — Merchant & Gould P.C.

(57) ABSTRACT

Door sensor hardware is provided that automatically senses the orientation of a door. The door sensor hardware includes electronic circuitry and sensor(s). The sensor(s) determine a current orientation of a door (open, closed, ajar), recent movement, door swing speed, and door acceleration. The door sensor hardware is in communication with at least remote device. The remote device includes a user display to facilitate calibration of the door sensor hardware by a user. The remote device also provides the user with the door orientation as determined by the door sensor hardware.

8 Claims, 12 Drawing Sheets

(56) References Cited

U.S. PATENT DOCUMENTS

| | | | | |
|---|---|---|---|---|
| 2010/0045053 | A1* | 2/2010 | Dye | E05B 47/0012 292/201 |
| 2010/0242368 | A1* | 9/2010 | Yulkowski | E05F 15/50 49/349 |
| 2011/0047874 | A1* | 3/2011 | Lowder | E05B 65/1053 49/31 |
| 2011/0203181 | A1* | 8/2011 | Magner | G08C 17/00 49/324 |
| 2014/0190082 | A1 | 7/2014 | Sheldon | |
| 2015/0102609 | A1* | 4/2015 | Johnson | E05B 1/0007 292/144 |
| 2015/0222517 | A1 | 8/2015 | McLaughlin et al. | |
| 2016/0010379 | A1* | 1/2016 | Sauerwein | E05F 5/00 701/49 |

* cited by examiner

ELECTRONIC LOCK WITH DOOR ORIENTATION SENSING

RELATED APPLICATIONS

This application claims the benefit of U.S. Provisional Application Ser. No. 62/277,171 filed Jan. 11, 2016, for an "Electronic Lock with Door Orientation Sensing," which is hereby incorporated by reference in its entirety.

TECHNICAL FIELD

The present disclosure relates generally to sensors for doors; in particular, this disclosure relates to sensors for detecting an orientation of a door.

BACKGROUND

Security systems are in widespread use in residential and commercial markets. These devices control ingress through doors to secured areas, such as a building or other secured space, by requiring certain authorized credentials. Existing security systems may include a sensor for determining whether a door is open or closed. While this type of sensor may be able to detect whether the door is open or closed, existing sensors are not able to provide exact door orientation. For example, existing sensors cannot determine whether a door is merely slightly ajar or completely open. Additionally, existing sensor cannot report on a previous orientation of the door. Moreover, installation of existing sensors can be time consuming and aesthetically unpleasing. For example, installers often are forced to separately install a magnet to a door and a magnetic sensor to molding surrounding the door (or visa versa). Although sensors are available in different colors to try to blend in with the door and molding colors, it can still have an unsightly appearance.

BRIEF DESCRIPTION OF THE FIGURES

The detailed description makes references to the accompanying figures in which.

DETAILED DESCRIPTION

Figure 1:
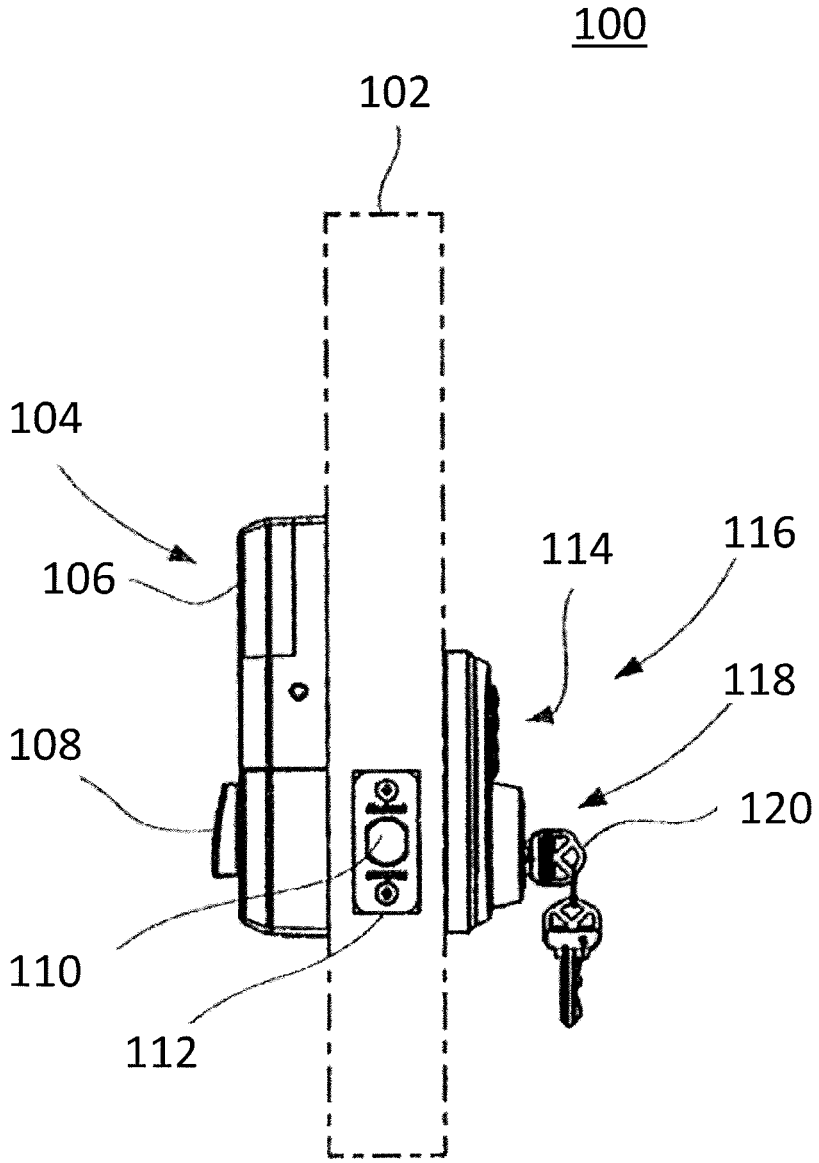
FIG. 1 is a side view of an electronic lock in accordance with an embodiment of the present invention, installed on a door and with the door shown in phantom lines.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

In some embodiments, this disclosure relates to a door orientation detection circuit that determines a door's orientation relative to a door jamb. For example, the door orientation detection circuit could detect whether a door is slightly ajar, completely open or somewhere in-between. In some cases, the door orientation detection circuit could determine if the door is currently being moved. Embodiments are contemplated in which the door orientation detection circuit may determine if the door has recently been moved. This door orientation data can be reported to a user, such as through the user's mobile device, stored in memory and/or other communicated with other computing devices, such as a home automation devices, security systems, etc. In some embodiments, the door orientation circuit could be integrated into door hardware, which would effectively hide the circuit from view, which is more aesthetically pleasing than existing sensors. The term "door hardware" is broadly intended to be construed as encompassing any hardware associated with a door, including but not limited to a lock, a door lever, a door knob, a hinge, etc. In some embodiments, the door orientation detection circuit could be separately installed on a door separate from the door hardware.

FIG. 1 shows an exemplary electronic lock 100 in accordance with an embodiment of the present disclosure mounted to a door 102. In the example shown, the electronic lock 100 includes an interior assembly 104 with a battery holder 106, a turn-piece 108, a bolt 110, a strike 112, a user input 114, an exterior assembly 116, a mechanical locking assembly 118, and a key 120. In some cases, the credentials and/or commands may be provided wirelessly to the electronic lock 100, such as disclosed in Pre-Grant Publication No. US 2012/0234058 for a "Wireless Access Control System and Related Methods," filed Mar. 8, 2012, which is hereby incorporated by reference. In another example, the electronic lock may be equipped to receive user credentials via touch activation, such as disclosed in U.S. Pat. No. 9,024,759, which is hereby incorporated by reference.

The electronic lock 100 may include a door orientation detection circuit 200 (FIG. 2) for sensing an orientation of the door 102 when in use with respect to a door jamb. The door orientation detection circuit 200 may further include one or more sensors that determine door orientation. Example sensors include, but are not limited to magnetometer, an accelerometer and a gyroscope (or collectively called an IMU (inertial measurement unit) or eCompass). In some embodiments, the door orientation detection circuit 200 may communicate an orientation of the door 102 substantially in real time. In some cases, the door orientation detection circuit 200 could communicate the orientation of the door upon being triggered by the door being opening by a certain threshold distance. This provides a technical advantage in that an orientation of the door 102 can be detected by the door orientation detection circuit 200 instead of merely detecting an open/closed position as with existing sensors. Although the door orientation detection circuit 200 is shown integrated into the electronic lock 100 for purposes of example, the door orientation circuit 200 could be integrated into any door hardware and/or installed separately on the door 102.

Figure 2:
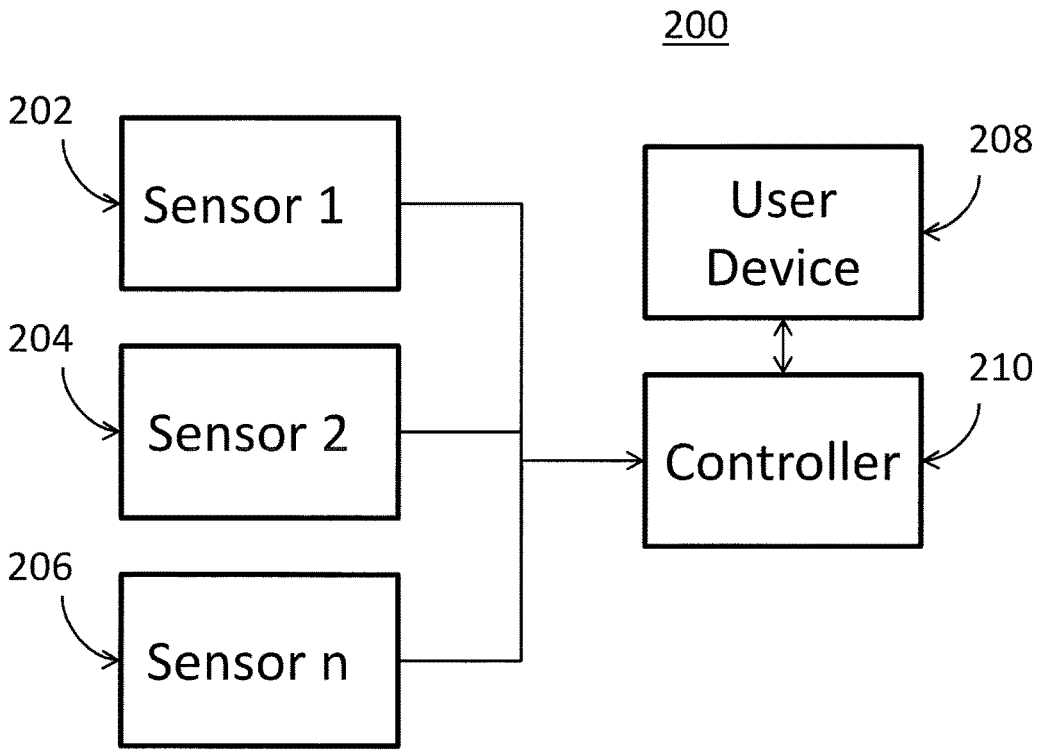
FIG. 2 is a simplified block diagram of an example control system for determining the orientation of a door according to an embodiment of the disclosure.

Referring to FIG. 2, there is shown an example door orientation detection circuit 200 for determining the orientation of door 102. In the example shown, the door orientation detection circuit 200 includes a controller 210 that may receive inputs from one or more sensors, sensor 1, sensor 2, sensor N . . . (sensors 202, 204, and 206), which could include a magnetometer, a accelerometer and a gyroscope (or collectively called an IMU [inertial measurement unit] or eCompass). Depending on the desired configuration, the electrical connection between the controller 210 and sensors 202, 204, 206 could be wired or wireless. In the embodiment shown, the controller 210 communicates door orientation data with a user device 208, such as a tablet computer, a smartphone, a mobile computing device, security system, home automation device, and/or other computing device. For example, the controller 210 may include a wireless communication module (not shown) that facilitates wireless communications with the user device 208 through any one or more associated wireless communication protocols (e.g., Bluetooth®, Wi-Fi®, WiMAX, Zigbee®, Z-Wave®, etc.). The term "door orientation data" is broadly intended to encompass any data related to orientation of a door, including but not limited to an orientation of a door in relation to a door jamb, movement of the door between orientations, when the door last moved between orientations, swing speed, distance opened, door acceleration, etc.

Figure 3:
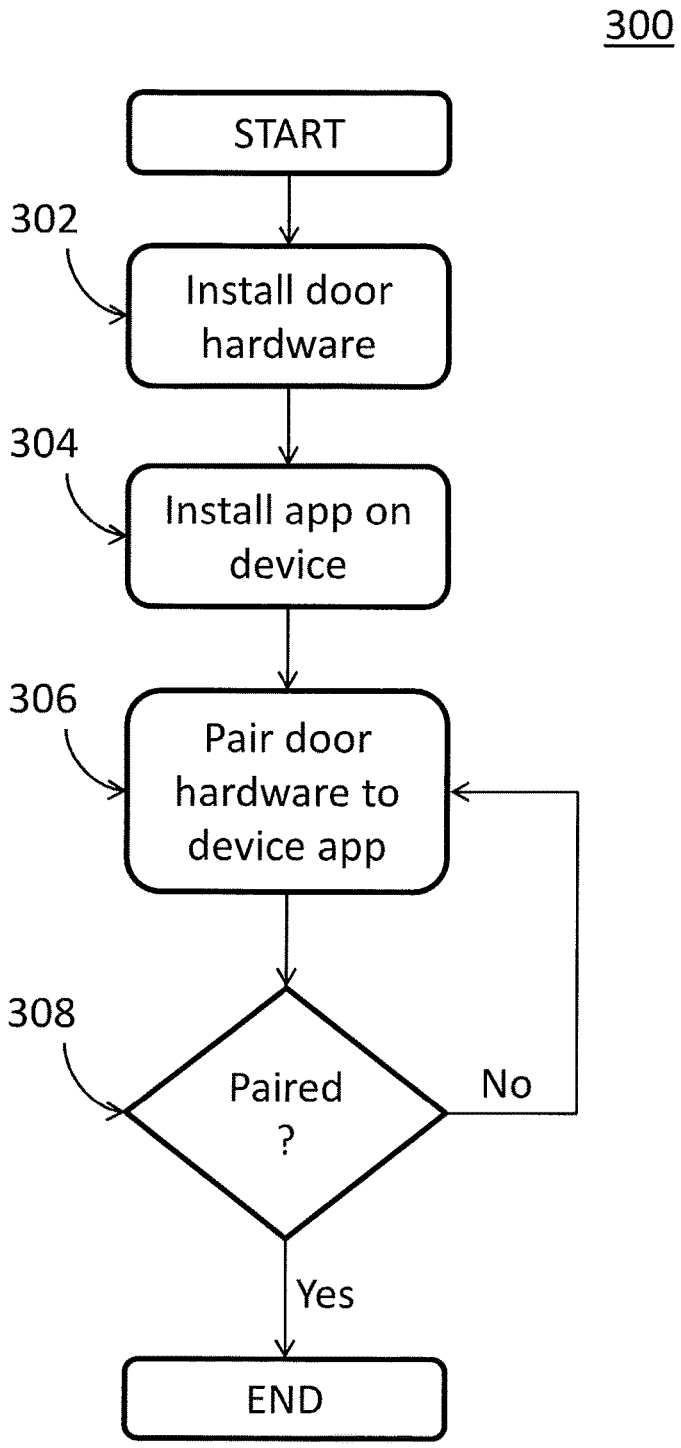
FIG. 3 is a flow diagram of an exemplary method for pairing the door sensor hardware with a computing device according to an embodiment of the disclosure.

FIG. 3 is a simplified flowchart showing an example pairing process of the door orientation detection circuit 200 with a software application embodied on a device, for example, a mobile device. In this example, method 300 starts with the installation of the necessary door hardware, step 302, for example, the sample configuration shown in FIG. 1. Installation may include the installation of sensors (e.g., 202, 204, and 206) and controller (e.g., 210) among other elements described in conjunction with FIG. 10. In some cases, door orientation detection circuit 200 may not need to be separately installed on the door, but is integral with the door hardware. Once the door sensor hardware is installed, the process moves to block 304 in which a software application is installed on a remote device (e.g., User device 208), such as a mobile device that includes a user interface. Once the software application is installed, the process moves to block 306 in which the door sensor hardware is paired with the device and the software application. Pairing may be done using short-range wireless communications, such as near-field communications or Bluetooth™. At step 308, if the pairing step is successful, the process ends. Otherwise the process goes back to step 306. Once the door hardware is paired with a device, the sensors are considered ready to be calibrated.

Figure 4:
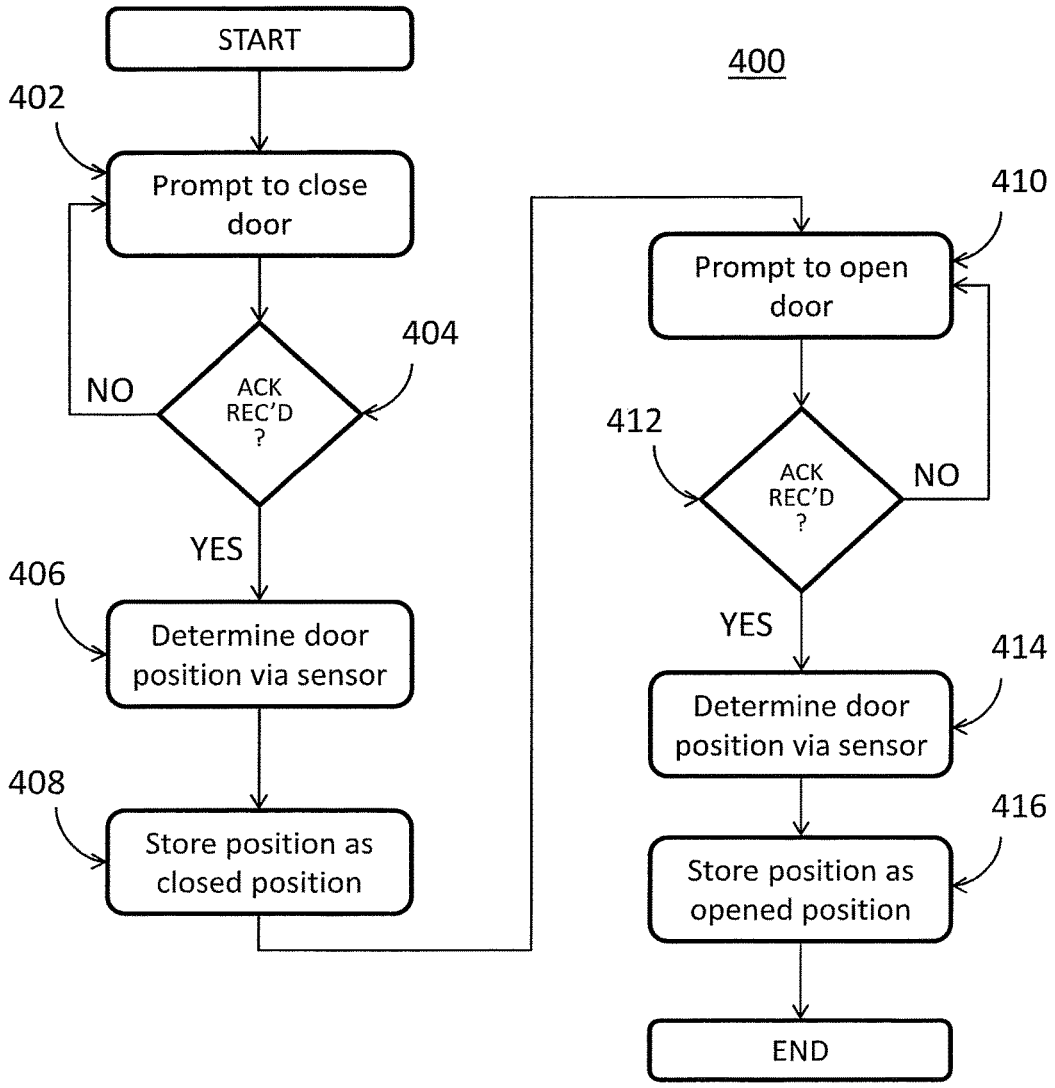
FIG. 4 is a flow diagram of an exemplary method for calibrating the door sensor hardware with a computing device according to an embodiment of the disclosure.
Figure 6:
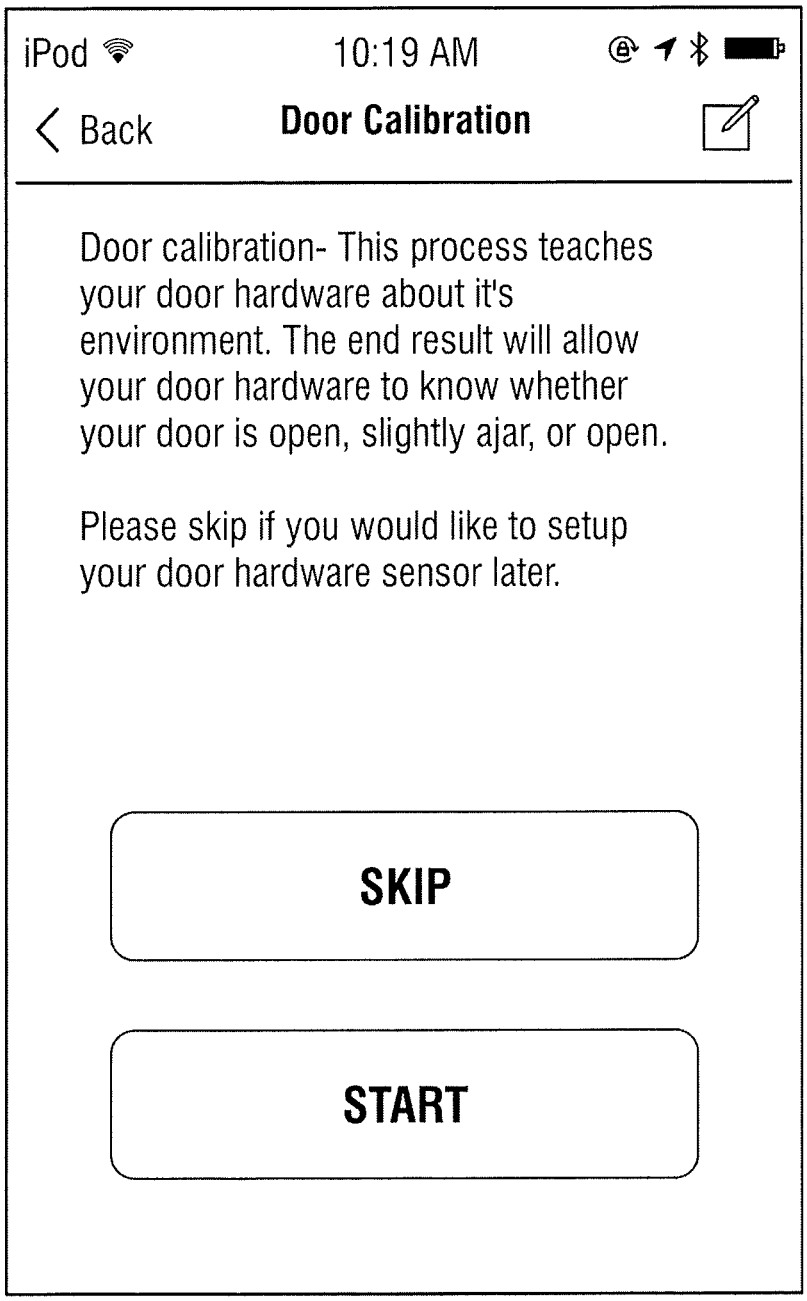
FIGS. 6-9 are exemplary user interfaces displayed on a computing device during the calibration process according to an embodiment of the disclosure.
Figure 7:
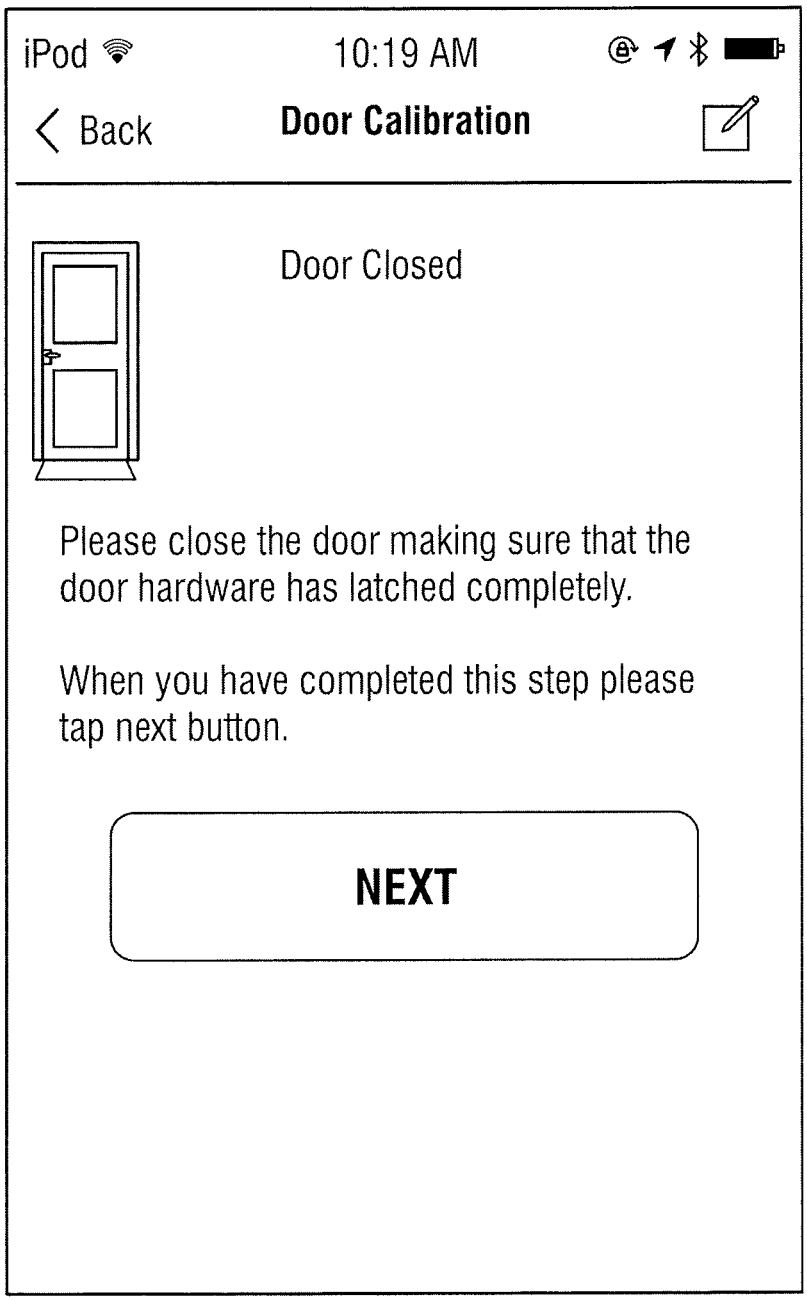
Figure 8:
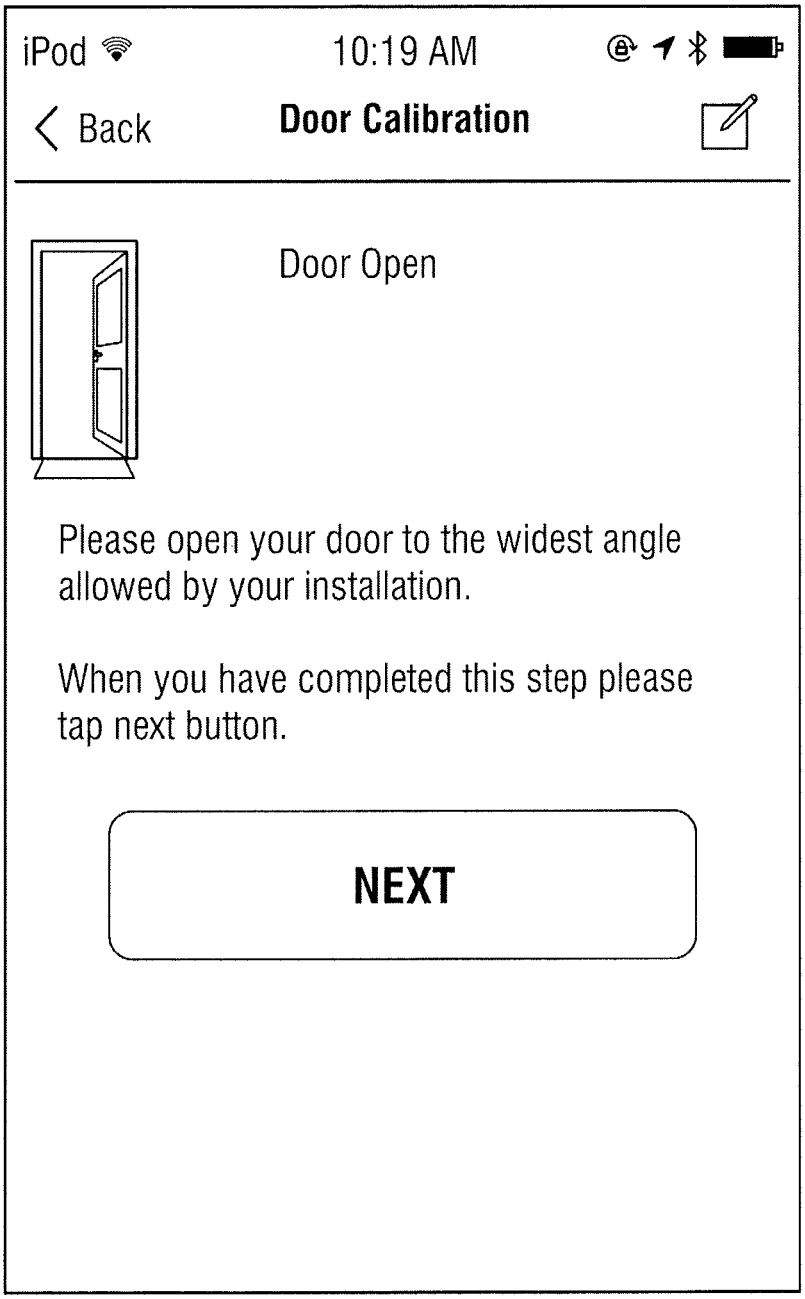
Figure 9:
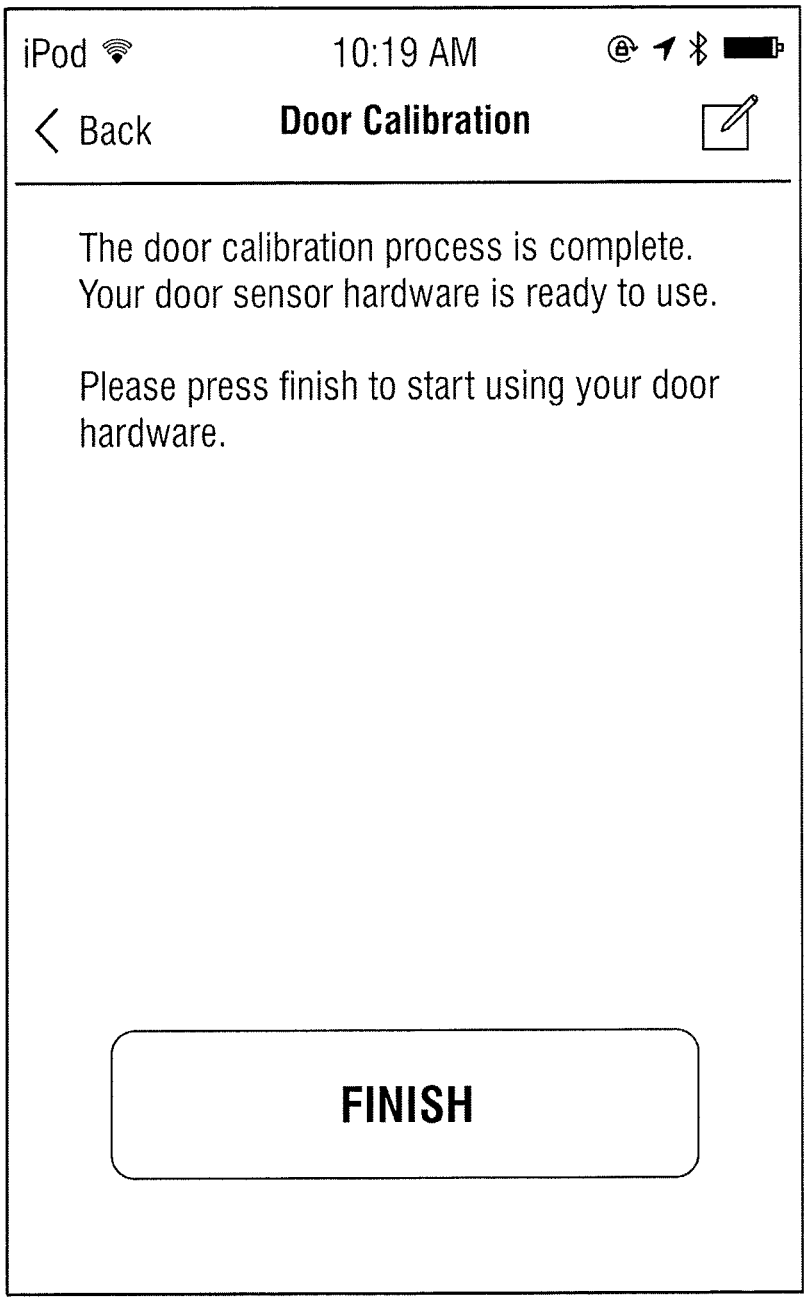

FIG. 4 is a simplified flowchart showing an example calibration process of the door orientation detection circuit 200 using the software application on the user device 208. A user of the device may initiate the process via the software application, as shown by the example in FIG. 6. In some embodiments, an interface on the door hardware, such as a switch, could initiate the calibration process. In this example, the method 400 begins with Block 402, in which a user is prompted by the user interface to close the door, as shown by the example user interface in FIG. 7. The user may acknowledge that the door is in the closed position by clicking the "NEXT" button. Once the door hardware receives an acknowledgement that the door is closed (step 404), the process moves on to step 406. If an acknowledgement is not received, the process may go back to step 402. In one embodiment, the door hardware may wait a certain period of time for an acknowledgement before re-prompting the user. At step 406, the current position of the door is determined by the installed sensors of the door hardware. At step 408, the determined position is then stored as the "closed" position. The process then moves to step 410 to determine the open position and a user is prompted by the user interface to open the door to its widest angle, as shown by the example user interface in FIG. 8. The user may acknowledge that the door is in the opened position by clicking the "NEXT" button. Once the door hardware receives an acknowledgement that the door is fully open (step 412), the process moves on to step 414. If an acknowledgement is not received, the process may go back to step 410. In one embodiment, the door hardware may wait a certain period of time for an acknowledgement before re-prompting the user. At step 414, the current position of the door is determined by the installed sensors of the door hardware. At step 416, the determined position is then stored as the "opened" position. The calibration process is then considered complete (see example user interface FIG. 9) and the process ends. The door sensor hardware is considered ready to use.

Figure 5:
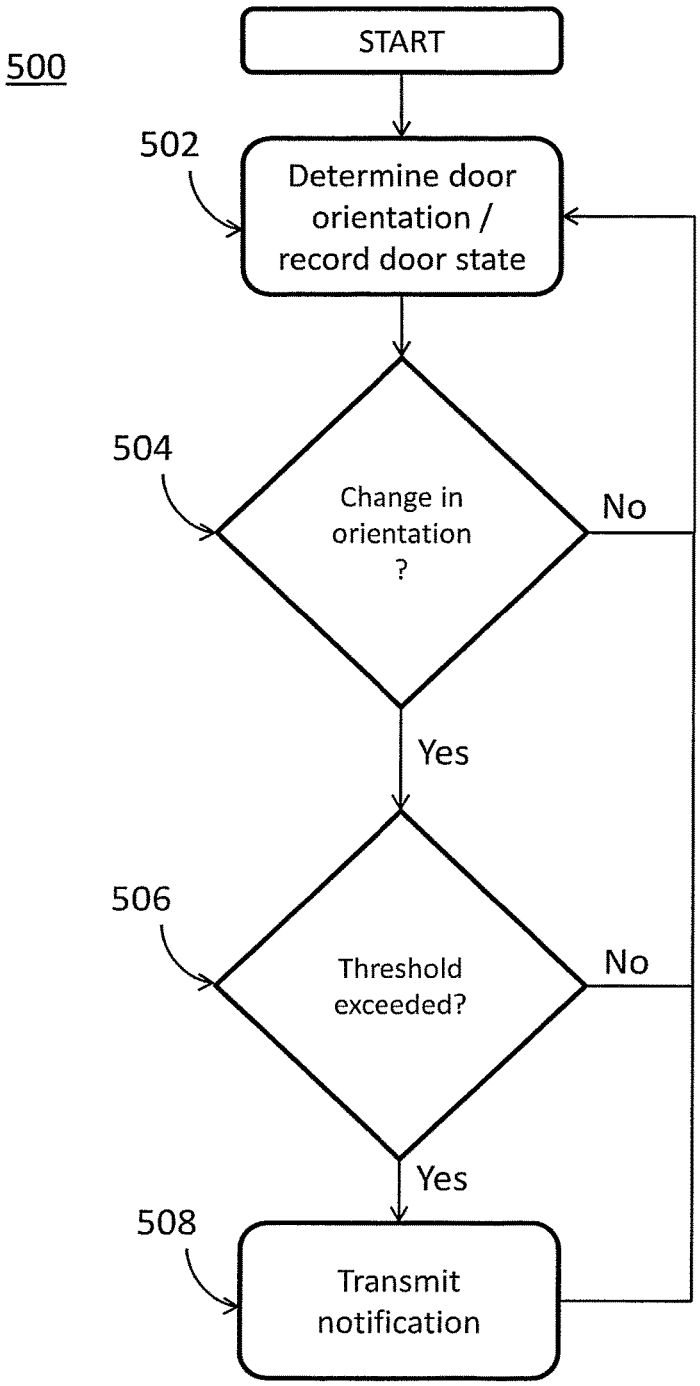
FIG. 5 is a flow diagram of an exemplary process for providing a notification of door orientation.

FIG. 5 is a simplified flow chart showing an example operation of the door orientation detection circuit 200 during use. The process 500 begins with step 502 wherein the door orientation is determined by the sensor(s). All data gathered by the sensor(s) may be stored locally in on-board memory. Alternatively, gathered data may be stored in a remote storage device. In block 504, it is determined whether the current orientation is different from recently data gathered. For example, a comparison is made between a recent orientation, a first position, and the current orientation, a second position. If not, the process moves back to 502. If a change is detected, the process moves to step 506. In step 506, it is determined whether the difference in orientation exceeds a certain threshold. The threshold variable may be a predetermined variable as set by a manufacturer, or in another embodiment may be specified by a user, or the like. The threshold variable may vary in distance, for example 1-inch or 6-inches. If the difference does not exceed a threshold, the process moves back to step 502. If the difference does exceed a threshold, the process continues. In step 508, a notification may be generated and transmitted. In one example, the notification may be sent to the user's device that is paired with the door sensor hardware to inform the user of door movement. The notification may include a message that the door has moved/changed orientation and may further include further data including, but not limited to, swing speed, acceleration, distance opened, change in state (e.g., closed, opened, left ajar, etc.), or the like.

In an alternative embodiment, a user may establish a direct connection with the door sensor hardware and view in real-time actual movement of the door. Using the data gathered by the installed sensors, the user interface may show in real-time not only the current position of the door but graphically display the door moving as well as the current swing speed and or acceleration of the door.

Figure 10:
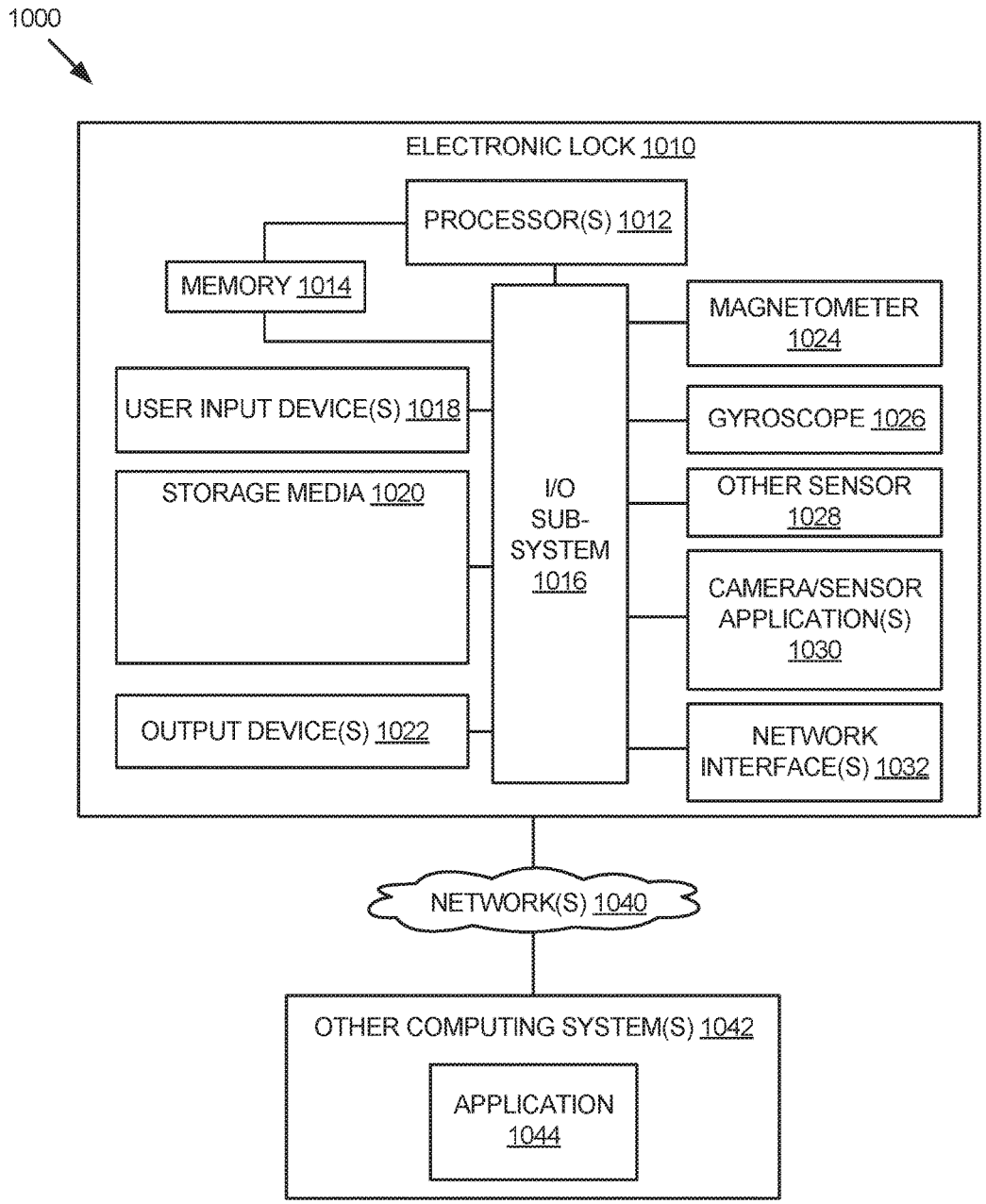
FIG. 10 is a simplified block diagram of an exemplary computing environment in connection with which at least one embodiment of the door sensor hardware of FIG. 1.

Referring now to FIG. 10, a simplified block diagram of an exemplary computing environment 1000 for the door lock 1010, in which the door sensor orientation application is shown. The illustrative implementation 1000 includes a door lock 1010, which may be in communication with one or more other computing systems or devices 1042 via one or more networks 1040. As shown, the door lock 1010 includes storage media 1020.

The illustrative computing device 1010 includes at least one processor 1012 (e.g. a microprocessor, microcontroller, digital signal processor, etc.), memory 1014, and an input/output (I/O) subsystem 1016. The computing device 1010 may be embodied as any type of computing device such as a personal computer (e.g., a desktop, laptop, tablet, smart phone, wearable or body-mounted device, etc.), a server, an enterprise computer system, a network of computers, a combination of computers and other electronic devices, or other electronic devices. Although not specifically shown, it should be understood that the I/O subsystem 1016 typically includes, among other things, an I/O controller, a memory controller, and one or more I/O ports. The processor 1012 and the I/O subsystem 1016 are communicatively coupled to the memory 1014. The memory 1014 may be embodied as any type of suitable computer memory device (e.g., volatile memory such as various forms of random access memory).

The I/O subsystem 1016 is communicatively coupled to a number of components including one or more user input devices 1018 (e.g., a touchscreen, keyboard, virtual keypad, microphone, etc.), one or more storage media 1020, one or more output devices 1022 (e.g., speakers, LEDs, etc.), one or more sensing devices in the form of a magnetometer 1024, a gyroscope 1026, or another sensor 1028, one or more camera or other sensor applications 1030 (e.g., software-based sensor controls), and one or more network interfaces 1032.

The storage media 1020 may include one or more hard drives or other suitable data storage devices (e.g., flash memory, memory cards, memory sticks, and/or others). In some embodiments, portions of systems software (e.g., an operating system, etc.), framework/middleware (e.g., APIs, object libraries, etc.). Portions of systems software or framework/middleware may be copied to the memory 1014 during operation of the computing device 1010, for faster processing or other reasons.

The one or more network interfaces 1032 may communicatively couple the computing device 1010 to a network, such as a local area network, wide area network, personal cloud, enterprise cloud, public cloud, and/or the Internet, for example. Accordingly, the network interfaces 1032 may include one or more wired or wireless network interface cards or adapters, for example, as may be needed pursuant to the specifications and/or design of the particular computing system 1000. The network interface(s) 1032 may provide short-range wireless or optical communication capabilities using, e.g., Near Field Communication (NFC), wireless fidelity (Wi-Fi), radio frequency identification (RFID), infrared (IR), or other suitable technology. Further, the wireless communications may use the Zigbee or Z-Wave protocols.

The other computing system(s) 1042 may be embodied as any suitable type of computing system or device such as any of the aforementioned types of devices or other electronic devices or systems. For example, in some embodiments, the other computing systems 1042 may include one or more server computers used to store portions of the data stored in storage media 1020. Further, computing device 1042 may further include application 1044 to provide an interface for display to a user to implement the embodiments of the disclosure set forth. The computing system 1000 may include other components, sub-components, and devices not illustrated in FIG. 10 for clarity of the description. In general, the components of the computing system 1000 are communicatively coupled as shown in FIG. 10 by electronic signal paths, which may be embodied as any type of wired or wireless signal paths capable of facilitating communication between the respective devices and components.

Figure 11:
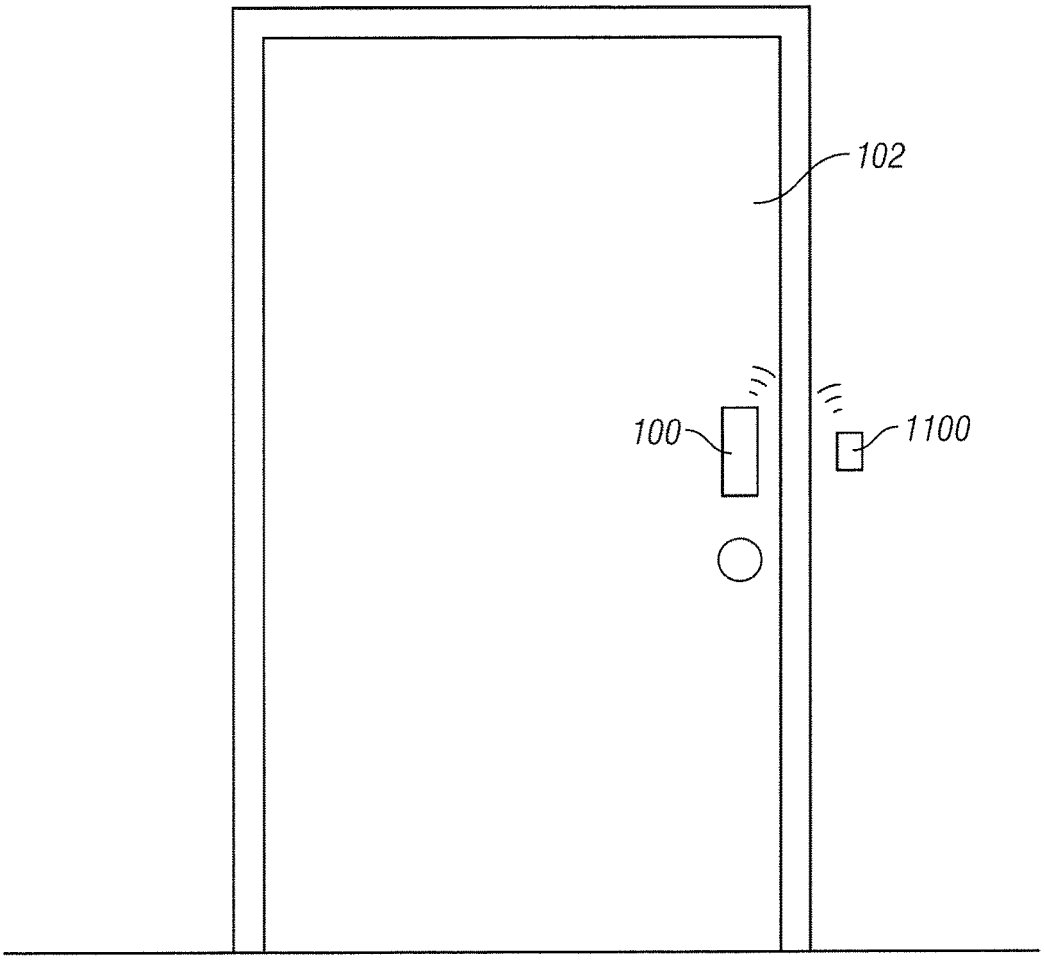
FIGS. 11 and 12 are simplified diagrammatic views of another embodiment for determining the orientation of a door with the door closed and open, respectively.
Figure 12:
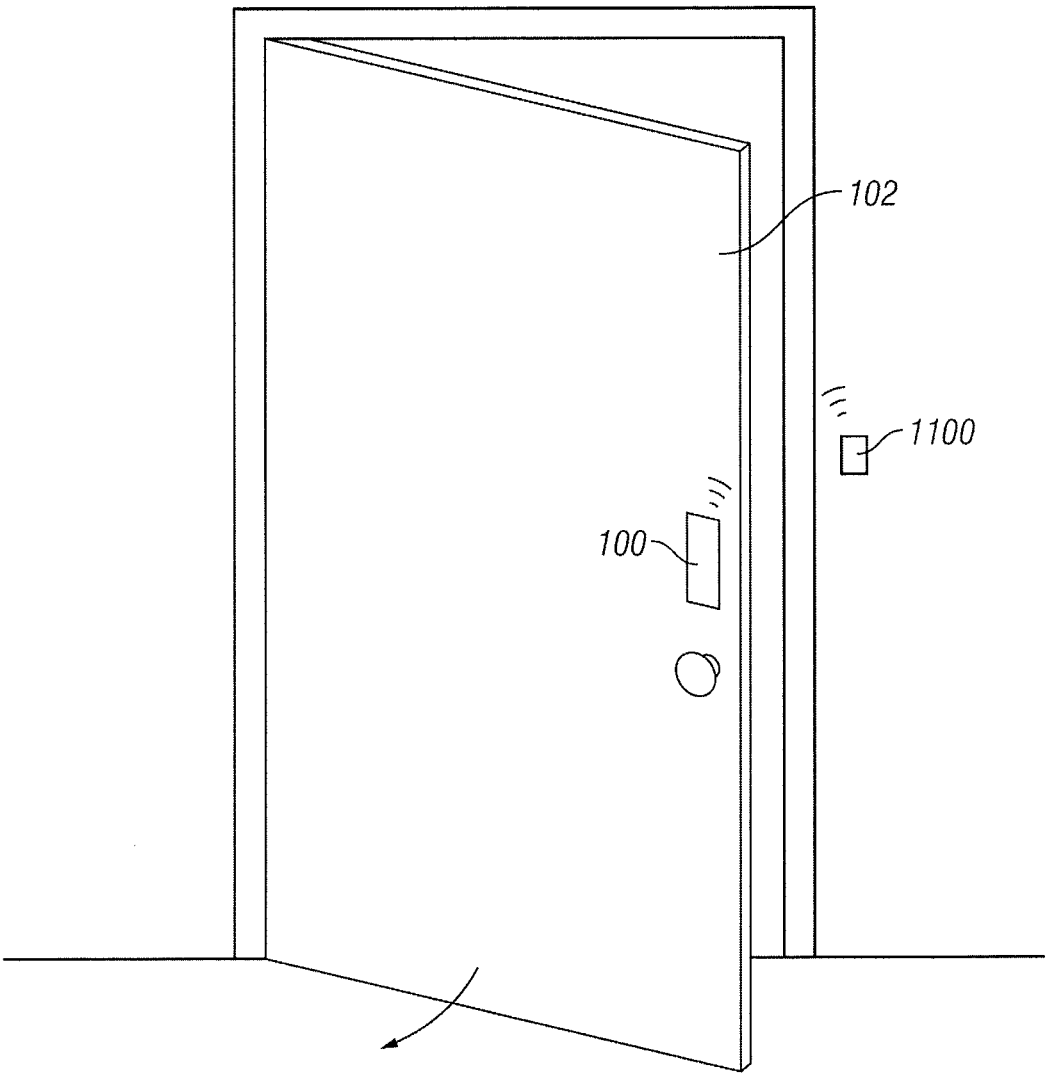

FIGS. 11 and 12 show another embodiment for determining the orientation of a door 102. In this embodiment, the electronic lock 100 is associated with a broadcast token 1100. In the example shown, the broadcast token 1100 has a fixed position, such as mounted in the door jamb. The broadcast token 1100 would transmit a wireless signal that could be received by the electronic lock 100. The broadcast token 1100 would emit a wireless signal using any wireless protocol, including but not limited to Bluetooth™ low energy, WiFi, or other wireless protocol or technology. The electronic lock 100 could determine the position of the door 102 based on the received signal strength indication ("RSSI") of the signal transmitted by the broadcast token 1100. The door closed position, as shown in FIG. 11, will have a relative RSSI value. The value of the RSSI will change as the distance between the electronic lock 100 and the broadcast token 1100 changes as the door opens, as shown in FIG. 12. This allows the electronic lock 100 to determine when the door is in the closed position based on the expected RSSI value corresponding to the closed position. Additionally, the electronic lock 100 would be able to determine whether the door 102 is only slightly ajar or fully open (and positions therebetween) based on the relative RSSI value, which correlates to the distance between the electronic lock 100 and the broadcast token 1100. Although FIGS. 11 and 12 show a swinging door 102 for purposes of example, the embodiment is applicable to a sliding door. As a sliding door travels linearly along a track, the distance between the electronic lock mounted on the sliding door and the broadcast token 1100 mounting in the door jamb would increase, which would change the relative RSSI value as the door travels between closed and open. Accordingly, for a sliding door, the electronic lock 100 would be able to determine whether the sliding door is closed, slightly open, fully open, and other positions between fully opened and closed.

EXAMPLES

Illustrative examples of the door sensor hardware disclosed herein are provided below. An embodiment of the door sensor hardware may include any one or more, and any combination of, the examples described below.

Example 1 is a door orientation detection circuit. The door orientation detection circuit is comprised of one or more sensors associated with a door configured to generate door position data indicative of a relative orientation of the door with respect to a door jamb and a controller in electrical communication with the one or more sensors, such that the controller is configured to wirelessly transmit the door position data.

In Example 2, the subject matter of Example 1 is further configured such that the one or more sensors include a magnetometer, an accelerometer, a gyroscope, an inertial measurement unit and/or or an eCompass.

In Example 3, the subject matter of Example 1 is configured such that the door position data includes an orientation of the door, door swing speed, and door acceleration.

In Example 4, the subject matter of Example 1 is further configured such that the controller is configured to calibrate the one or more sensors by: generating a prompt to close the door; storing a current position of the door as a closed position in response to receiving an acknowledgement that the door is closed; generating a prompt to open the door; and storing the current position of the door as an opened position in response to receiving an acknowledgement from the user that the door is opened.

In Example 5, the subject matter of Example 1 is configured such that the controller is configured to transmit the door position data in response to detecting a change in door orientation.

In Example 6, the subject matter of Example 5 is configured such that the controller is configured to transmit the door position data in response to the change in door orientation being to be in excess of a predetermined threshold.

In Example 7, the subject matter of Example 1 is further configured such that the door orientation detection circuit is integral with door hardware.

Example 8 is a door hardware assembly. The door hardware assembly is comprised of a door hardware comprising a lock assembly, a door hinge, and/or a door handle. The door orientation detection circuit is configured to generate door position data indicative of a relative orientation of the door with respect to a door jamb and wirelessly transmit the door position data, such that at least a portion of the door orientation detection circuit is integral with the door hardware.

In Example 9, the subject matter of Example 8 is configured such that the door orientation detection circuit includes a magnetometer, an accelerometer, and a gyroscope (or collectively called an IMU [inertial measurement unit] or eCompass).

In Example 10, the subject matter of Example 8 is further configured such that the door position data comprises at least one of orientation of the door, door swing speed, and door acceleration.

In Example 11, the subject matter of Example 8 is configured such that the door orientation detection circuit is configured to be calibrated by: generating a prompt to close the door; storing a current position of the door as a closed position in response to receiving an acknowledgement that the door is closed; generating a prompt to open the door; and storing the current position of the door as an opened position in response to receiving an acknowledgement that the door is opened.

In Example 12, the subject matter of Example 8 is configured such that the door orientation detection circuit is configured to transmit door position data in response to detecting a change in door orientation.

In Example 13, the subject matter of Example 12 is further configured such that the door orientation detection circuit is configured to transmit door position data in response to detecting a change in door orientation in excess of a threshold.

Example 14 is a method for detecting the orientation of a door. The method for detecting the orientation of a door is comprised of installing door hardware on a door. The door hardware comprising at least one or more sensors which detects position data of the door by the one or more sensors, pairs the door sensor hardware with a user device, calibrates the one or more sensors, and transmits the door position data to the user device.

In Example 15, the subject matter of Example 14 is configured such that the one or more sensors include a magnetometer, an accelerometer, a gyroscope, an inertial measurement unit and/or or an eCompass.

In Example 16, the subject matter of Example 14 is configured such that the position data comprises at least one of orientation of the door, door swing speed, and door acceleration.

In Example 17, the subject matter of Example 14 is further configured such that the calibrating further comprises: prompting a user of the user device to close the door; storing the current position of the door as a closed position in response to receiving an acknowledgement from the user that the door is closed; prompting the user to open the door; and storing the current position of the door as an opened position in response to receiving an acknowledgement from the user that the door is opened.

In Example 18, the subject matter of Example 14 is configured such that the door position data is transmitted to the user device in response to detecting a change in door orientation.

In Example 19, the subject matter of Example 18 is configured such that the change is determined to be in excess of a threshold.

In Example 20, the subject matter of Example 19 is configured such that the threshold is user-specified.

In Example 21, the subject matter of Example 14 is configured such that the door orientation is at least one of open, closed, and partly open.

In Example 22, the subject matter of Example 19 is configured such that the threshold is determined by using a magnetometer, an accelerometer, a gyroscope, an inertial measurement unit and/or or an eCompass.

Example 23 is a door orientation detection circuit. The door orientation detection circuit is comprised of one or more broadcast tokens configured to generate a wireless signal and a controller operationally associated with a door such that the controller is movable concomitant with movement of the door, wherein the controller is configured to receive the wireless signal and determine a relative position of the door based on a received signal strength indication ("RSSI") of the wireless signal.

In Example 24, the subject matter of Example 23 is configured such that the one or more broadcast tokens are configured to be mounted in a door jamb associated with the door.

In Example 25, the subject matter of Example 23 is configured such that the controller can determine whether an orientation of the door is at least one of open, closed, and partly open.

In Example 26, the subject matter of Example 23 is configured such that the one or more broadcast tokens communicate in one or more of Bluetooth or WiFi protocols.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

The invention claimed is:

1. A door orientation detection circuit comprising:

one or more sensors associated with a door and configured to generate door position data indicative of a relative orientation of the door with respect to a door jamb; and a controller in electrical communication with the one or more sensors, wherein the controller is configured to:

wirelessly transmit the door position data; and calibrate the one or more sensors, wherein calibrating the one or more sensors comprises the controller performing:

generating a prompt to close the door;

storing a current position of the door as a closed position in response to receiving an acknowledgement that the door is closed;

generating a prompt to open the door; and storing the current position of the door as an opened position in response to receiving an acknowledgement from the user that the door is opened.

2. The circuit of claim 1, wherein the one or more sensors includes at least one sensor selected from the group consisting of: a magnetometer, an accelerometer, a gyroscope, an inertial measurement unit, and an eCompass.

3. The circuit of claim 1, wherein the door position data includes an orientation of the door, door swing speed, and door acceleration.

4. The circuit of claim 1, wherein the controller is configured to transmit the door position data in response to detecting a change in door orientation.

5. The circuit of claim 4, wherein the controller is configured to transmit the door position data in response to the change in door orientation being in excess of a predetermined threshold.

6. The circuit of claim 1, wherein the door orientation detection circuit is integral with door hardware.

7. A door hardware assembly comprising:

door hardware comprising a lock assembly, a door hinge, and/or a door handle; and a door orientation detection circuit according to claim 1;

wherein at least a portion of the door orientation detection circuit is integral with the door hardware.

8. The circuit of claim 6, wherein the door hardware includes a lock assembly, a door hinge, and/or a door handle.

* * * * *